US005800774A

United States Patent [19]

Willett

[11] Patent Number: 5,800,774

[45] Date of Patent: Sep. 1, 1998

[54] HEAT TREATING FURNACE AND METHOD

[75] Inventor: Gordon H. Willett, Grosse Pointe Farms, Mich.

[73] Assignee: Therm Alliance Company, Detroit, Mich.

[21] Appl. No.: 730,135

[22] Filed: Oct. 15, 1996

[51] Int. Cl.[6] ..... C21D 9/54

[52] U.S. Cl. ..... 266/105; 266/252

[58] Field of Search ..... 266/249, 252, 266/105

[56] References Cited

U.S. PATENT DOCUMENTS

| | | | |
|---|---|---|---|
| 3,340,109 | 9/1967 | Keough | 148/153 |
| 3,620,517 | 11/1971 | Keough | 263/6 R |
| 3,650,853 | 3/1972 | Keough | 148/143 |
| 5,242,156 | 9/1993 | Kay | 266/105 |

FOREIGN PATENT DOCUMENTS

| | | | |
|---|---|---|---|
| 9143018 | 8/1984 | Japan | 266/252 |

*Primary Examiner*—Scott Kastler

*Attorney, Agent, or Firm*—Young & Basile, P.C.

[57] ABSTRACT

A heat treating furnace including a housing defining a chamber, a heavy high thermal capacity cast link endless conveyor belt positioned within the chamber for moving articles to be heat treated through the chamber, a narrow elongated vestibule passage extending forwardly from the chamber, and a light low thermal capacity wire mesh endless belt conveyor extending from a furnace loading location forwardly of the vestibule passage through the vestibule passage to a location within the chamber in vertically spaced overlying relation to the forward end portion of the cast link conveyor. The vestibule passage minimizes loss of heat treating atmosphere from the furnace chamber, and curtains are provided in the vestibule passage to further minimize atmosphere loss. The light feed conveyor is run at a higher linear speed than the heavy furnace conveyor so that the load on the feed conveyor and the vertical profile of the parts on the feed conveyor may be reduced. The low mass and low thermal capacity of the wire mesh feed conveyor also minimizes the furnace heat loss occasioned by the continuous movement of the feed conveyor between the heated furnace chamber and the relatively cool outside atmosphere.

22 Claims, 3 Drawing Sheets

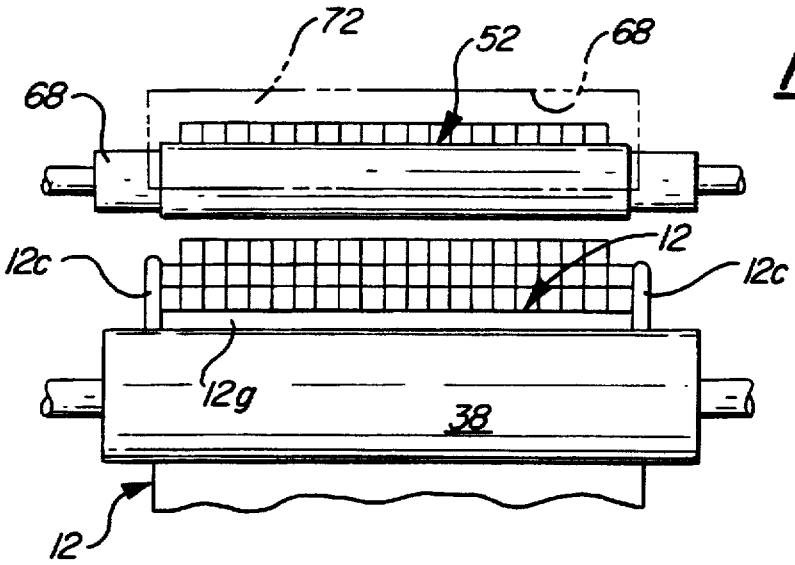
FIG-3
FIG-4
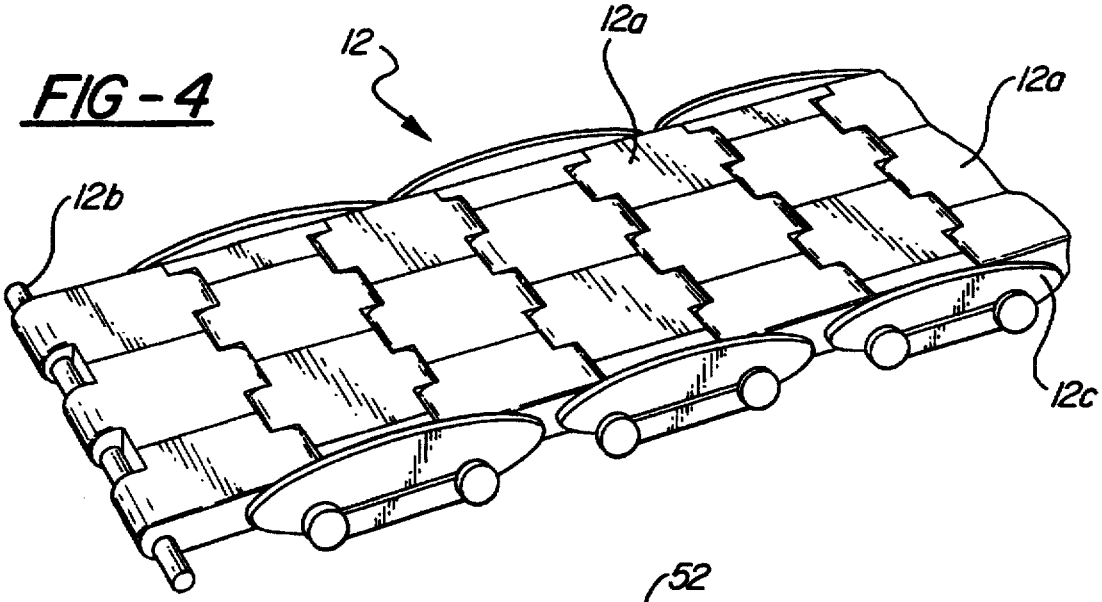
FIG-5
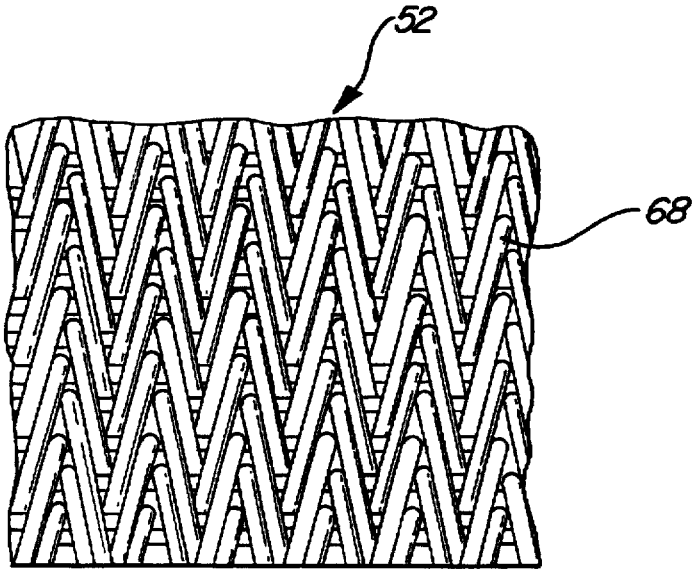

HEAT TREATING FURNACE AND METHOD

BACKGROUND OF THE INVENTION

This invention relates to heat treating furnaces and more particularly to a heat treating furnace of the type in which a controlled atmosphere is maintained within the furnace to facilitate the heat treatment of parts passing through an enclosed chamber defined within the furnace.

It is common practice in a heat treating furnace to employ a cast link endless belt conveyor within the furnace to carry the articles through the enclosed furnace chamber while creating and maintaining a controlled atmosphere within the enclosed chamber consistent with the desired treatment to be afforded to the parts. It is necessary that the parts to be treated be transferred from a location outside the furnace to within the furnace for depositing on the cast link conveyor. Current technology generally employs one of three systems for achieving this transfer.

The first transfer system involves the use of either a shaker pan or a vibratory pan that sits in front of the furnace and transfers the parts through a small slotted opening at the entrance of the furnace housing over the conveyor belt. The pan either is reciprocated via a shaker arrangement or is vibrated. The portion of the pan that is within the furnace is made of alloy so as to withstand the high temperatures. This system embodies several problems. Specifically, some parts advance more readily than others so that the feed rate is not accurate; the overhung alloy pan is susceptible to damage from either cracking, which degrades the transfer performance, or drooping due to its own weight which causes it to contact the cast link belt causing belt tracking problems; parts dropping off the pan onto the cast link belt become trapped between the bottom of the pan and the top of the cast link belt resulting in damaged parts due to the back and forth movement of the pan; and it is difficult to maintain a satisfactory container atmosphere within the furnace as the location of the slot and the necessary short entrance distance tends to reduce back pressure within the furnace and result in air infiltration which destroys the quality of the atmosphere and causes the operator to increase atmosphere flow to overcome the flow of infiltrating air.

The second transfer system employs a chute over the top of the cast link conveyor at the entrance end which is used to slide the parts into the furnace from above and onto the cast link belt. This system creates difficulty in maintaining a good atmosphere within the furnace because of air infiltration through the large chute opening. Further, because the parts slide onto the cast link belt from some distance away, the parts enter the belt at a relatively high velocity which causes them to travel some distance down the conveyor belt before friction or preceding parts stop them. As a result, the arriving parts can travel a greater or lesser distance along the belt, thereby uncontrollably varying the amount of time that the parts spend in the controlled atmosphere of the furnace. Further, the parts can be damaged by contact with the cast link belt or with other parts.

The third transfer system involves a separate endless load conveyor in combination with a series of chutes arranged in cascade fashion. The entrance to the load conveyor is at a level below the work height of the cast link belt conveyor with the result that a back pressure is maintained within the furnace chamber whereby to reduce furnace atmosphere consumption and improve atmosphere control. The problems with this system are that the parts must cascade through a series of chutes down onto the cast link belt conveyor with resultant part damage; the openings between successive chutes limit the size of the parts which can be conveyed; and the parts suffer from high entrance velocity with the result that they may be damaged by contact with the cast link belt and the distance that they travel down the cast link belt upon being deposited varies with consequent uncontrolled variations in the time spent in the furnace.

SUMMARY OF THE INVENTION

This invention is directed to the provision of an improved heat treating furnace and an improved heat treat methodology.

More specifically, this invention is directed to the provision of a heat treating furnace having an improved loading mechanism.

Yet more specifically, this invention is directed to the provision of a heat treating furnace employing a simple loading mechanism which provides an even feed of parts to the furnace, delivers the parts to the cast link belt without damage to the parts, ensures that each part will spend the same amount of time in the furnace with the same heat treating effect, and simplifies the control of a proper desired atmosphere within the furnace.

The invention relates to a heat treating furnace of the type including a furnace housing defining a closed furnace chamber; means for creating and maintaining a controlled atmosphere within the chamber; and an endless heat transfer conveyor positioned in the chamber and having an entry end position proximate an entry end of the chamber.

According to an important feature of the invention furnace, an endless feed conveyor extends from an entry end position outside of the furnace housing and through an opening in the furnace housing to a location within the chamber where a discharge end of the feed conveyor is positioned in overlying, vertically spaced relation to the entry end of the heat treat conveyor. With this arrangement, the parts are delivered directly and uniformly to the furnace without damage to the parts and without significantly compromising the atmospheric conditions within the furnace.

According to a further feature of the invention, the feed conveyor has a mass per unit length less than the mass per unit length of the heat treat conveyor. With this arrangement, the feed conveyer may be utilized to load parts into the furnace for handling by the furnace conveyor while minimizing the loss of furnace heat caused by the absorption of heat by the feed conveyor each time it enters the furnace and the commensurate loss of heat as the heated feed conveyor leaves the furnace, while the high thermal capacity furnace belt never leaves the furnace chamber and is therefore not the cause of any loss of heating efficiency. In the disclosed embodiment of the invention, the feed conveyor comprises a fine mesh wire belt conveyor of low thermal capacity and the furnace conveyor comprises a cast link conveyor of high thermal capacity.

According to a further feature of the invention furnace, the furnace includes drive means operative to drive the heat treat conveyor at a first linear speed and the feed conveyor at a second linear speed greater than the first linear speed. With this arrangement, the feed conveyor may be more lightly loaded than the furnace conveyor so as not to overload the feed conveyor but, by virtue of its faster speed than the furnace conveyor, is effective to deliver a heavier load per unit length to the furnace conveyor consistent with the greater strength of the furnace conveyor.

According to a further feature of the invention furnace, the furnace housing further defines a generally horizontal elongated vestibule passage extending outwardly from the entry opening in the entry end of the housing and having a height substantially less than the height of the furnace chamber, and the upper run of the feed conveyor passes through the vestibule passage. This arrangement provides a heat buffer zone between the interior of the furnace and the outside atmosphere and allows the furnace to be equipped with curtains or other sealing means in the vestibule passage to minimize loss of furnace atmosphere.

The invention also provides an improved heat treating methodology. According to the improved heat treating methodology, a furnace housing is provided defining a main heat treating chamber having a forward end and a rearward end and an elongated vestibule passage extending from the forward end of the main chamber and including an inboard end opening in the main chamber and an outboard end opening into the outside atmosphere; a controlled heat treating atmosphere is created and maintained within the main chamber; an endless furnace conveyor is provided including a forward end, a rearward end, and an upper run extending between the forward and rearward ends; the endless furnace conveyor is positioned in the main chamber with the forward end thereof proximate the front end of the chamber, the rearward end thereof proximate the rearward end of the chamber, and the upper run thereof positioned below the opening of the inboard end of the vestibule passage in the main chamber; an endless feed conveyor is provided having an outboard end, an inboard end, and an upper run extending between the outboard and inboard ends; the endless feed conveyor is positioned with the outboard end thereof positioned at a material loading location outside of the housing, the inboard end thereof positioned within the main chamber in overlying vertically spaced relation to the forward end of the furnace conveyor, and the upper run thereof passing through the vestibule passage; drive means are provided which are operative to drive the feed conveyor in a sense to move the upper run thereof inwardly through the vestibule passage and operative to drive the furnace conveyor in a sense to move the upper run thereof rearwardly within the main chamber; and material to be heat treated is deposited on the outboard end of the feed conveyor at the loading station. Material is thus moved along the upper run of the feed conveyor through the vestibule passage and into the main chamber, is deposited from the inboard end of the feed conveyor onto the forward end of the furnace conveyor, and moves rearwardly along the upper run of the furnace conveyor through the main chamber for treating in the heat treating atmosphere. With this methodology, parts to be heat treated may be delivered to the furnace conveyor at a uniform and consistent rate, the parts may be delivered without damage, and the delivery may be accomplished without significant derogation of the controlled atmosphere within the chamber.

According to a further feature of the invention methodology, the drive means is operated in a manner to drive the feed conveyor at a linear speed greater than the linear speed of the furnace conveyor. With this methodology, the feed conveyor may be more lightly loaded per unit length than the furnace conveyor for a given furnace throughput so as to allow the use of a relatively low mass feed conveyor and a relatively high mass furnace conveyor.

According to a further feature of the invention methodology, the feed conveyor is constructed with a relatively low mass per unit length and the furnace conveyor is constructed with a relatively high mass per unit length. With this methodology the heat loss from the furnace chamber is minimized by virtue of the relatively low thermal capacity of the feed conveyor.

BRIEF DESCRIPTION OF THE DRAWING

FIG. 3 is a cross-sectional view taken on line 3—3 of FIG. 2;

FIG. 4 is a detail view of a cast link belt conveyor employed in the invention furnace; and FIG. 5 is a detail view of a fine wire mesh belt conveyor employed in the invention furnace.

DETAILED DESCRIPTION OF THE PREFERRED EMBODIMENT

Figure 1:
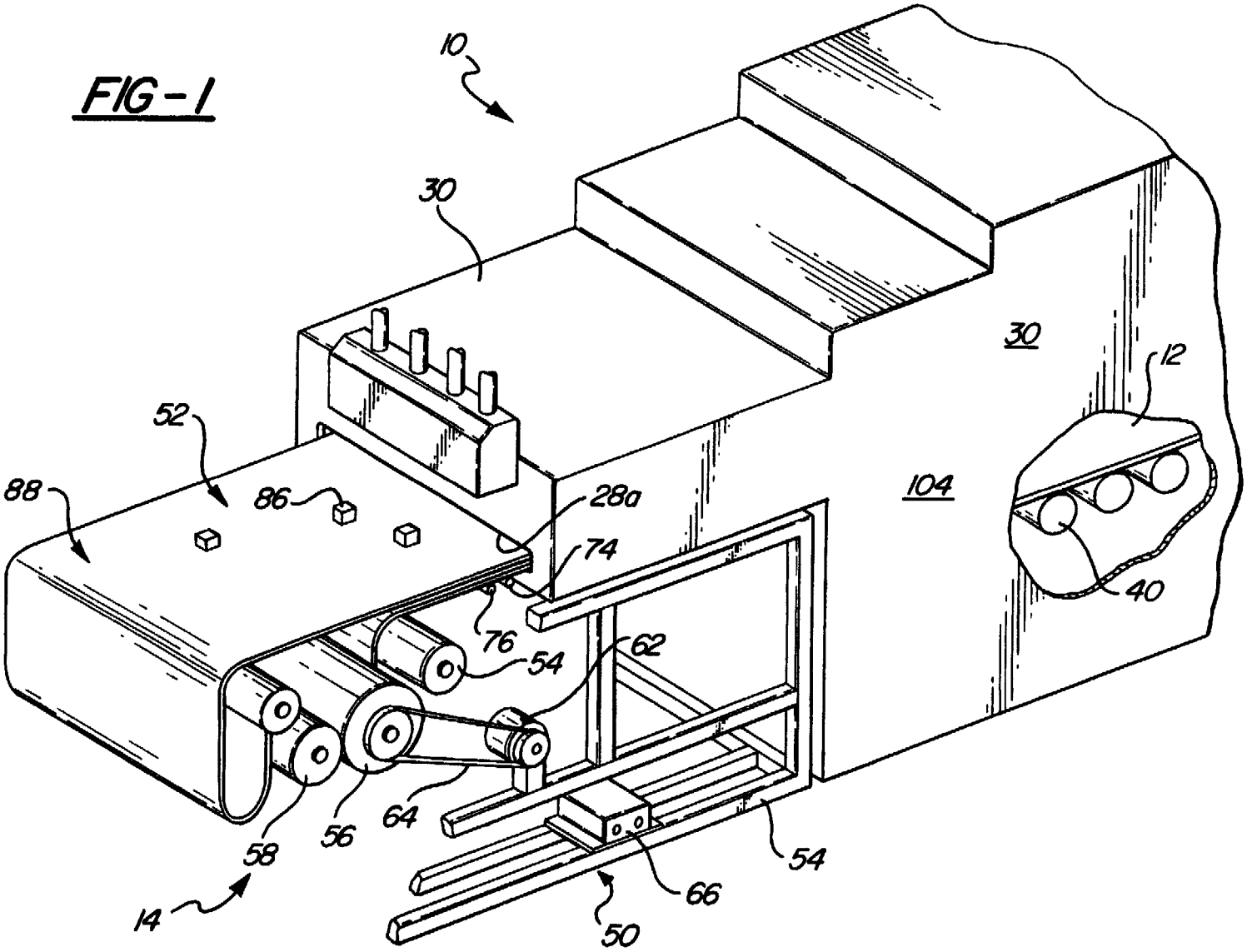
FIG. 1 is a perspective somewhat schematic view of a heat treating furnace according to the invention.
Figure 2:
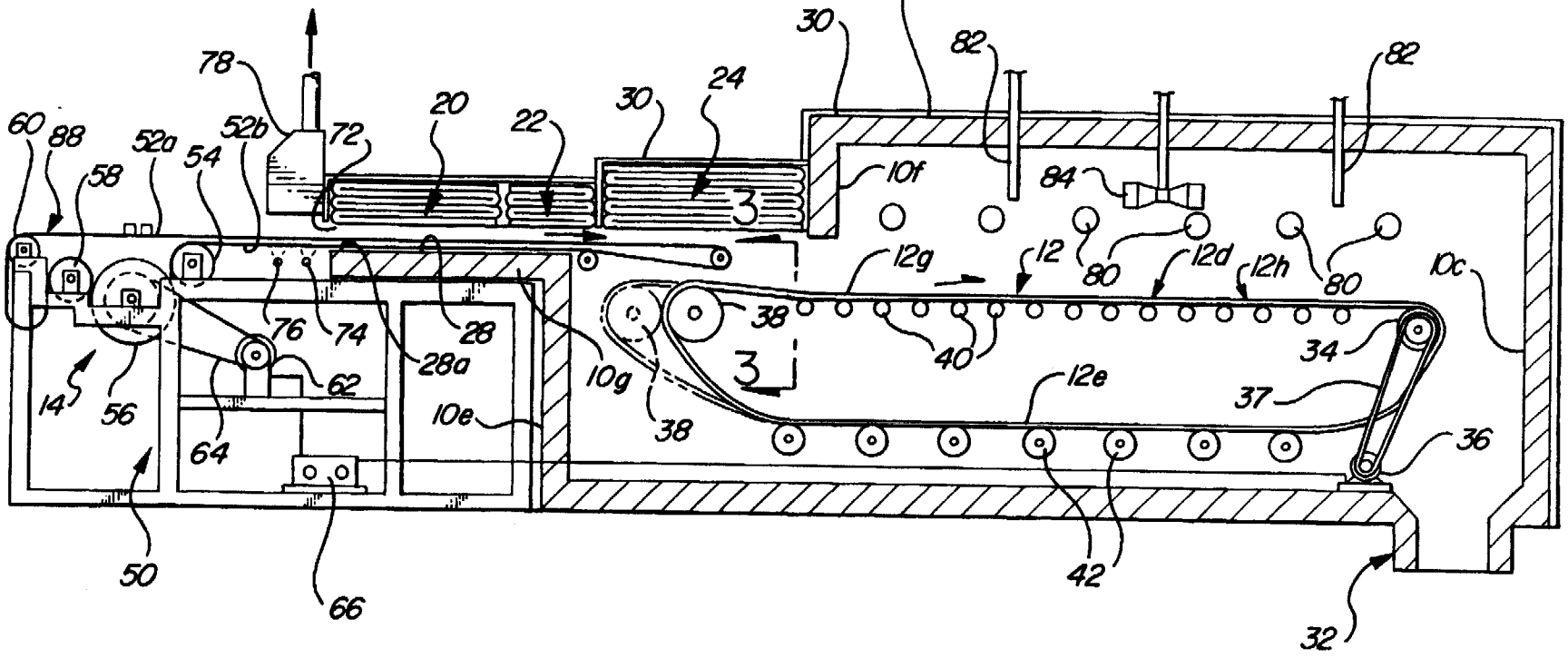
FIG. 2 is a cross-sectional view of the invention furnace.

The heat treating furnace of the invention, broadly considered, includes a housing 10, a heat treatment conveyor 12, a loading mechanism 14, means 16 to create a heat treatment atmosphere within the furnace, and drive means 18.

Housing 10 includes a top wall 10*a*, a bottom wall 10*b*, a rear wall 10*c*, side walls 10*d*, a front lower wall 10*e*, a front upper wall 10*f*, and a vestibule wall 10*g*, all formed of a suitable insulating ceramic material. The housing further includes ceramic fiber insulating material in the form of folded batting 20, 22 and 24 positioned in overlying relation to vestibule wall 10*g* and the forward portion of bottom wall 10*b*. Batting 20, 22 and 24 coacts with the ceramic insulating walls to define a furnace main chamber 26, an entry opening 26*a* leading into the chamber 26, and a narrow elongated vestibule passage 28 extending forwardly from the entry opening 26*a* to a vestibule passage front end or outboard opening 28*a*. The vestibule passage 28 will be seen to have a very small vertical height as compared to the vertical height of main chamber 26. The entire furnace may be suitably enclosed in metal sheathing 30 and a chute 32 proximate the rear end of housing bottom wall 10*b* provides access to a quenching bath (not shown) in conventional fashion.

Heat treating conveyor 12 comprises a high mass, high thermal capacity, heavy duty conveyor preferably of the cast link belt type seen in detail in FIG. 4. Conveyor 12 includes a series of cast alloy pieces 12*a* suitably pinned together by pins 12*b* and side guards 12*c* along the outboard edges of the conveyor to retain parts on the conveyor.

Conveyor 12 comprises an endless conveyor and is positioned totally within furnace chamber 26. Specifically, conveyor 12 is trained around a rearward drive roller 34 driven by a suitable electric motor 36 and belt 37; a large forward guide roller 38; a plurality of small upper support rollers 40 positioned between rollers 34 and 38; and lower support rollers 42. Guide roller 38 is moveable in known manner (utilizing pneumatic cylinders for example) from a cold furnace solid line position to a hot furnace dash line position to maintain proper chain tension. The described conveyor mounting defines an upper conveyor run 12*d* and a lower or return conveyor run 12*e*. The upper run 12*d* will be seen to include a slightly downwardly inclined portion 12*g* extending rearwardly between roller 38 and the first support roller 40, and a generally flat portion 12*h* extending rearwardly over the successive rollers 40 to drive roller 34.

Loading mechanism 14 includes a drive and load table assembly 50 and a feed or load conveyor 52.

Drive and load table assembly 50 includes a stand 54 formed of suitable metallic beam material and sized to be nested beneath the forward end of the furnace housing beneath the vestibule lower wall log. Assembly 50 further includes a support roller 54, a drive roller 56, a pinch roller 58, and a further support roller 60, all suitably supported on stand 50 with drive roller 56 suitably driven by drive motor 62 via a drive belt 64. Drive motor 62 and drive motor 36 are suitably electrically connected to a control unit 66 which may be mounted, for example, on stand 54.

Feed or load conveyor 52 is a low mass, low thermal capacity conveyor as compared to furnace conveyor 12 and, as seen in FIG. 5, comprises a fine mesh wire belt conveyor including a plurality of metal wires 68 arranged in a woven or mesh configuration in known manner. Conveyor belt 52 is trained successively over support roller 54, drive roller 56, pinch roller 58, support roller 60, a rearward guide roller 69 positioned in furnace chamber 26 in overlying vertically spaced relation to the forward portion 12*g* of the upper run 12*d* of conveyor 12, and a further guide roller 70 positioned in chamber 26 immediately forwardly of and below entry opening 26*a*. The various rollers define an upper run 52*a* extending between forward support roller 60 and rearward guide roller 68, and a lower run 52*b* extending from rearward guide roller 68 over guide roller 70 and successively around rollers 54, 56, 58 and 60. Guide roller 70 has the effect of decreasing the distance between the upper and lower runs of the conveyor to facilitate the passage of the upper and lower runs through vestibule passage 28.

A plurality of successive flexible curtains 72 are positioned in the upper region of vestibule passage 28 in overlying relation to the upper run 52*a* of conveyor 52 so as to provide a partial atmospheric seal as between furnace chamber 26 and the exterior atmosphere. A gas tube 74 is provided beneath the upper run 52*a* of belt 52 immediately forwardly of vestibule outboard opening 28*a* to burn off oxygen and an air tube 76 is provided immediately forwardly of gas tube 74 to cool belt 52. An exhaust assembly 78 is positioned on the forward end of the vestibule housing in overlying relation to the upper run of the feed belt.

Atmosphere creating means 16 includes a plurality of gas burners 80 adapted to direct heated gaseous material into chamber 26 to heat the chamber in known manner, one or more gas pipes 82 extending downwardly through upper furnace wall 10*a* and positioned to direct conditioning specialized gas into the chamber 26, and one or more fans 84.

The gas entering chamber 26 through gas pipes 82 creates an endothermic atmosphere within the chamber typically used for clean hardening, carbon restoration, carburizing and carbonitriding process applications. The endothermic atmosphere is prepared in an external generator or through blending nitrogen and methanol together under controlled conditions. The gas injected into the furnace chamber through pipes 82 has the effect of maintaining a positive pressure within the chamber such, for example, as a ¼" positive atmosphere. It will be understood that leakage of atmosphere out of the furnace chamber 26 requires the addition of atmospheric gases through the pipes 82 with a consequent increase in the cost of operating the furnace and, conversely, a reduction in the atmospheric loss through leakage from chamber 26 has the effect of reducing the amount of atmospheric gas that must be supplied through pipes 82 and thereby reducing the cost of operating the furnace.

Fan 84 has the effect of circulating the furnace atmosphere gases provided to chamber 26 through pipes 82 to provide a more uniform distribution of the gases.

Drive means 18 is constituted by the drive means 36 for furnace belt 12 and the drive means 62 for feed belt 52, and the control 66 is operated in a manner to impart a higher linear speed to the feed belt than to the furnace belt. For example, feed belt 52 may be driven at a linear speed of 60 feet per hour while conveyor belt 12 may be driven at a linear speed of 20 feet per hour.

In the operation of the furnace, parts or articles 86 to be heat treated are deposited on the upper run 52*a* of the feed conveyor at a furnace loading location 88 whereafter the parts progress rearwardly along the upper run 52*a* and through the vestibule passage 28 until they reach the rearward guide roller 69 where they are dropped or deposited onto the forward portion 12*g* of the upper run 12*d* of the furnace conveyor 12 for movement through the furnace along upper run 12*d* for suitable heat treatment. Upon arrival at the rearward guide roller 42 the parts are dropped off of the furnace conveyor for passage through chute 32 and entry into the quenching bath in known manner.

Curtains 72 have the effect of closing the upper region of the vestibule passage at all times and yet are flexible enough to allow the passage of parts 86 through the vestibule passage. The low, initial height of the vestibule passage 28, in combination with the blocking effect of the curtains 72, has the effect of minimizing the loss of furnace atmosphere gases through the vestibule passage and thereby minimizing the amount of atmosphere gases that must be continuously added to the chamber 26 through pipes 82.

As noted, the feed conveyor 52 is preferably operated at a greater linear speed than that of the furnace conveyor so that, for a given throughput on the feed conveyor and on the furnace conveyor, the feed conveyor may be more lightly loaded in proportion to the extent to which the feed conveyor's linear speed exceeds the furnace conveyor's linear speed. For example, and as seen in FIG. 3, if the feed conveyor is operating at a linear speed of 60 feet per hour and the furnace conveyor is operating at a linear speed of 20 feet per hour, the parts 86 may be stacked on the feed conveyor to a height of, for example, 1" and the parts on the furnace conveyor may be stacked to a height of 3", thereby minimizing the load on the relatively light weight feed conveyor, maximizing the load on the sturdy heavy weight furnace conveyor, and further minimizing the vertical height requirements of the vestibule passage.

It will be seen that the invention furnace and methodology provide many important advantages as compared to prior art furnaces. Specifically, the parts are fed into the furnace at an even, uniform speed; the problems with the overhang portion of the shaker pan or vibrating pan are eliminated, including the problem of parts caught between the pan and the heat transfer conveyor; the leakage loss of furnace atmosphere gases is minimized, thereby minimizing the amount of atmosphere gases that must be continuously added to the furnace chamber and minimizing the cost of operating the furnace; the part damage caused by dropping of the parts down a chute onto the furnace conveyor is eliminated; the problem with varying heat treatment time in the furnace caused by varying extents to which the parts falling down the chute tumble along the furnace conveyor before coming to rest is eliminated; the amount of heat taken out the furnace via the feed mechanism is minimized by virtue of the low mass and low thermal capacity of the mesh feed conveyor and the short duration of the time which any given portion of the feed conveyor spends in the furnace; the vestibule passage provides preheating of the incoming parts so as to increase the overall efficiency of the furnace; the narrow vertical profile presented by the parts on the feed belt, by virtue of the higher linear speed of the feed belt, enables the vestibule passage opening and height to be minimized thereby minimizing loss of furnace atmosphere; minimizing the vertical profile of the parts on the feed belt also has the effect of minimizing the distance that the parts must drop from the feed belt onto the cast link belt so as to further minimize part damage and part disruption; the distance that the parts must drop from the feed belt onto the cast link belt is further minimized by the small diametric size of the rearward guide roller for the feed belt; and the furnace has the ability to accommodate all of the various heat treating processes currently in use.

Whereas a preferred embodiment of the invention has been illustrated and described in detail, it will be apparent that various changes may be made in the disclosed embodiment without departing from the scope or spirit of the invention.

I claim:

1. A heat treating furnace for heat treating articles, the furnace comprising:

a furnace housing defining a closed furnace chamber;

means for creating and maintaining a controlled atmosphere within the chamber;

an endless generally horizontally extending heat treat conveyor positioned in the chamber and having an entry end positioned proximate an entry end of the chamber; and an endless generally horizontally extending feed conveyor extending from an entry end positioned outside of the furnace housing and through an entry opening in the furnace housing to a location within the chamber where a discharge end of the feed conveyor is positioned in horizontally overlapping and directly overlying relation to the entry end of the heat treat conveyor so that articles entering the chamber on the feed conveyor drop directly onto the entry end of the heat treat conveyor.

2. A heat treating furnace according to claim 1 wherein the feed conveyor has a mass per unit length less than the mass per unit length of the heat treat conveyor.

3. A heat treating furnace according to claim 1 wherein the furnace includes drive means operative to drive the heat treat conveyor at a first linear speed and the feed conveyor at a second linear speed greater than the first linear speed.

4. A heat treating furnace according to claim 2 wherein the heat treating conveyor comprises a cast link conveyor and the feed conveyor comprises a fine mesh belt conveyor.

5. A heat treating furnace according to claim 1 wherein:

the furnace housing further defines an elongated vestibule passage extending outwardly from the entry opening in the entry end of the chamber and having a height substantially less than the height of the chamber; and the feed conveyor passes through the vestibule passage.

6. A heat treating furnace including a furnace housing defining a furnace chamber, an endless heat treat conveyor positioned totally within the chamber and including a generally horizontal upper run extending from an entry end positioned at a location proximate a front entry end of the chamber to a discharge end positioned at a location proximate a rear discharge end of the chamber, means for creating and maintaining a controlled heat treating atmosphere in the chamber, and a loading mechanism for loading articles into the chamber for heat treatment within the chamber, wherein:

the furnace housing includes an entry end having an entry opening communicating with the chamber; and the loading mechanism comprises an endless feed conveyor including a generally horizontally extending upper run having an entry end positioned at a location outside of the furnace housing and forwardly of the entry end of the chamber and extending rearwardly through the entry opening in the entry end of the furnace housing to a discharge end of the feed conveyor upper run positioned at a location within the chamber in horizontally overlapping and directly overlying relation to the entry end of the heat treat conveyor upper run, whereby articles deposited on the entry end of the upper run of the feed conveyor are moved along the upper run of the feed conveyor and through the entry opening in the entry end of the furnace housing to the discharge end of the upper run of the feed conveyor from where they dropped directly onto the entry end of the upper run of the heat treat conveyor for movement through the heat treating atmosphere of the chamber to heat treat the articles.

7. A heat treat furnace according to claim 6 wherein the feed conveyor has a mass per unit length less than the mass per unit length of the heat treat conveyor.

8. A heat treat furnace according to claim 6 wherein the furnace includes drive means operative to drive the heat treat conveyor at a first linear speed and the feed conveyor at a second linear speed greater than the first linear speed.

9. A heat treat furnace according to claim 7 wherein the heat treat conveyor comprises a cast link conveyor and the feed conveyor comprises a fine mesh belt conveyor.

10. A heat treat furnace according to claim 6 wherein:

the furnace housing further defines a generally horizontally extending vestibule passage extending forwardly from the entry opening in the entry end of the housing and having a height substantially less than the height of the furnace chamber; and the upper run of the feed conveyor passes through the vestibule passage.

11. A heat treat furnace including a furnace housing defining a furnace chamber, an endless heat treat conveyor positioned totally within the furnace chamber and including a generally horizontally extending upper run extending from a location proximate a front entry end of the chamber to a location proximate a rear discharge end of the chamber, means for creating and maintaining a controlled heat treating atmosphere in the chamber, and a loading mechanism for loading articles into the chamber for heat treatment within the chamber, wherein:

the furnace housing includes an entry end having an entry opening communicating with the chamber; and the loading mechanism comprises an endless feed conveyor having a mass per unit length less than that of the heat treat conveyor and including a generally horizontally extending upper run having an entry end positioned at a location outside of the furnace housing and forwardly of the entry end of the chamber and extending through the entry opening in the entry end of the furnace housing to a discharge end of the upper run positioned at a location within the chamber in horizontally overlapping and directly overlying relation to a front end entry portion of the upper run of the heat treat conveyor, whereby articles deposited on the entry end of the upper run of the feed conveyor are moved along the upper run and through the entry opening in the entry end of the furnace housing to the discharge end of the upper run of the feed conveyor from where they drop directly onto the entry portion of the upper run of the heat treat conveyor for movement through the furnace to heat treat the articles.

12. A heat treating furnace according to claim 11 wherein the furnace further includes drive means operative to drive the heat treat conveyor at a first speed and the feed conveyor at a second linear speed greater than the first linear speed.

13. A heat treating furnace according to claim 11 wherein:

the heat treat conveyor comprises a cast link conveyor; and the feed conveyor comprises a fine mesh belt conveyor.

14. A heat treat furnace according to claim 11 wherein:

the furnace housing further defines a generally horizontal elongated vestibule passage extending forwardly from the entry opening in the entry end of the housing and having a height substantially less than the height of the furnace chamber; and the upper run of the feed conveyor passes through the vestibule passage.

15. A heat treating furnace comprising:

a furnace housing defining a closed furnace chamber having an entry opening at an entry end of the chamber and an elongated narrow vestibule passage extending outboard from the furnace chamber entry opening;

means for creating and maintaining a controlled atmosphere within the chamber;

an endless generally horizontally extending heat treat conveyor positioned in the furnace chamber and having an entry end positioned proximate the entry end of the chamber; and an endless generally horizontally extending feed conveyor having an entry end positioned outside of the furnace housing proximate a loading station for the furnace, a discharge end positioned within the furnace chamber in horizontally overlapping and directly overlying relation to the entry end of the heat treat conveyor, and a generally horizontal upper run extending from the feed conveyor entry end, through the vestibule passage, and through the entry opening to the furnace conveyor discharge end, articles deposited onto the entry end of the feed conveyor moving alone the upper run of the feed conveyor and through the vestibule passage to the discharge end of the feed conveyor where they drop directly onto the entry end of the heat treat conveyor.

16. A heat treating furnace according to claim 15 wherein the feed conveyor has a mass per unit length less than the mass per unit length of the heat treat conveyor.

17. A heat treating furnace according to claim 15 wherein the furnace includes drive means operative to drive the heat treat conveyor at a first linear speed and the feed conveyor at a second linear speed greater than the first linear speed.

18. A heat treating furnace according to claim 16 wherein the heat treat conveyor comprises a cast link conveyor and the feed conveyor comprises a fine mesh wire belt conveyor.

19. A method of heat treating material comprising:

providing a furnace housing defining a main heat treating chamber having a forward end and a rearward end and an elongated vestibule passage extending from the forward end of the main chamber and including an inboard end opening in the main chamber and an outboard end opening into the outside atmosphere;

creating and maintaining a controlled heat treating atmosphere within the main chamber;

providing an endless generally horizontally extending furnace conveyor including a forward end, a rearward end, and an upper run extending between the forward and rearward ends;

positioning the endless furnace conveyor in the main chamber with the forward end thereof proximate the front end of the chamber, the rearward end thereof proximate the rearward end of the chamber, and the upper run thereof positioned below the opening of the inboard end of the vestibule passage in the main chamber;

providing an endless generally horizontally extending feed conveyor having an outboard end, an inboard end, and an upper run extending between the outboard and inboard ends;

positioning the endless feed conveyor with the outboard end thereof positioned at a material loading location outside of the housing, the inboard end thereof positioned within the main chamber in horizontally overlapping and directly overlying relation to the forward end of the furnace conveyor, and the upper run thereof passing through the vestibule passage;

providing drive means operative to drive the feed conveyor in a sense to move the upper run thereof inwardly through the vestibule passage and operative to drive the furnace conveyor in a sense to move the upper run thereof rearwardly within the main chamber; and depositing material to be heat treated on the outboard end of the feed conveyor at the loading station so that the material moves along the upper run of the feed conveyor through the vestibule passage and into the main chamber, drops directly from the inboard end of the feed conveyor onto the forward end of the furnace conveyor, and moves rearwardly along the upper run of the furnace conveyor through the main chamber for treating in the heat treating atmosphere.

20. A method according to claim 19 including the further step of constructing the feed conveyor with a relatively low mass per unit length and constructing the furnace conveyor with a relatively high mass per unit length.

21. A method according to claim 20 including the further step of constructing the feed conveyor as a wire mesh belt conveyor and constructing the furnace conveyor as a cast link conveyor.

22. A method of heat treating material comprising:

providing a furnace housing defining a main heat treating chamber having a forward end and a rearward end and an elongated vestibule passage extending from the forward end of the main chamber and including an inboard end opening in the main chamber and an outboard end opening into the outside atmosphere;

creating and maintaining a controlled heat treating atmosphere within the main chamber;

providing an endless furnace conveyor including a forward end, a rearward end, and an upper run extending between the forward and rearward ends;

positioning the endless furnace conveyor in the main chamber with the forward end thereof proximate the front end of the chamber, the rearward end thereof proximate the rearward end of the chamber, and the upper run thereof positioned below the opening of the inboard end of the vestibule passage in the main chamber;

providing an endless feed conveyor having an outboard end, an inboard end, and an upper run extending between the outboard and inboard ends;

positioning the endless feed conveyor with the outboard end thereof positioned at a material loading location outside of the housing, the inboard end thereof positioned within the main chamber in overlying, vertically spaced relation to the forward end of the furnace conveyor, and the upper run thereof passing through the vestibule passage;

providing drive means operative to drive the feed conveyor in a sense to move the upper run thereof inwardly through the vestibule passage and operative to drive the furnace conveyor in a sense to move the upper run thereof rearwardly within the main chamber;

depositing material to be heat treated on the outboard end of the feed conveyor at the loading station whereby the material may move along the upper run of the feed conveyor through the vestibule passage and into the main chamber, be deposited from the inboard end of the feed conveyor onto the forward end of the furnace conveyor, and move rearwardly along the upper run of the furnace conveyor through the main chamber for treating in the heat treating atmosphere; and operating the drive means in a manner to drive the feed conveyor at a linear speed greater than the linear speed of the furnace conveyor so that the feed conveyor may be more lightly loaded per unit length than the furnace conveyor for a given furnace throughput.

* * * * *